United States Patent [19]

Fu-Long

[11] Patent Number: 4,700,993

[45] Date of Patent: Oct. 20, 1987

[54] AUXILIARY DRAWER STRUCTURE ON TOP SURFACE ON A DESK

[76] Inventor: Chung Fu-Long, No. 139, Chung Chen Road Sec. 1, Changhua City, Taiwan

[21] Appl. No.: 13,062

[22] Filed: Feb. 10, 1987

[51] Int. Cl.[4] ..... A47B 51/00

[52] U.S. Cl. ..... 312/312; 312/196; 312/306

[58] Field of Search ..... 312/312, 306, 196

[56] References Cited

U.S. PATENT DOCUMENTS

| | | | |
|---|---|---|---|
| 1,099,521 | 6/1914 | Sprung | 312/196 |
| 1,307,261 | 6/1919 | Lee | 312/306 |
| 2,861,857 | 11/1958 | Lee et al. | 312/312 |
| 3,297,387 | 1/1967 | Parsons | 312/312 |
| 3,985,410 | 10/1976 | Young et al. | 312/306 |
| 3,997,028 | 12/1976 | Lopez | 312/306 |
| 4,088,380 | 5/1978 | Watts | 312/306 |

*Primary Examiner*—Victor N. Sakran

*Attorney, Agent, or Firm*—Browdy and Neimark

[57] ABSTRACT

An auxiliary drawer structure on top surface of a desk, it relates to the effective utilization of spaces for a desk, in particular, those spaces which are below the top face and by the rear side of a desk. Of which, the desk surface at the location said above is furnished with comparatively larger rectangular openings for receiving the longitudinally inserted box-shaped drawer, and the top surfaces of each lid on each of this box-shaped drawers are aligned flatly and evenly with the desk face after drawers are pressed into the rectangular openings. An extension/compression spring is furnished on bottom side of each drawer to serve self-rising purpose of each drawer, also guiding blocks and guided-swinging and positioning devices are furnished to both left and right-side respectively of each drawer for locking up when the drawer is risen up to a certain position or pressed down to its hide out position. These rising-up and hiding-out functions are repetitive when the drawer is pressed downwardly once after another.

5 Claims, 8 Drawing Figures

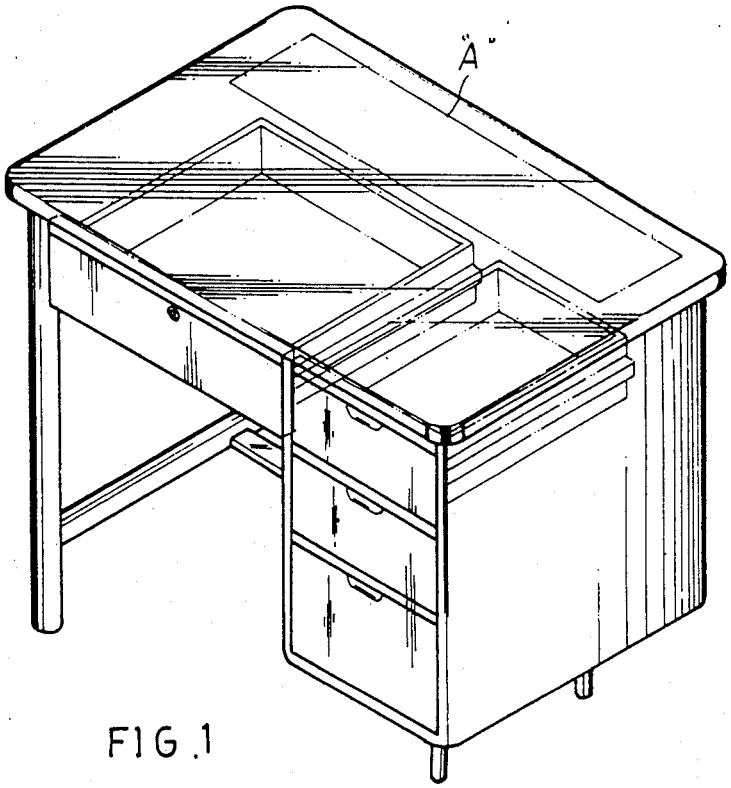
FIG. 1
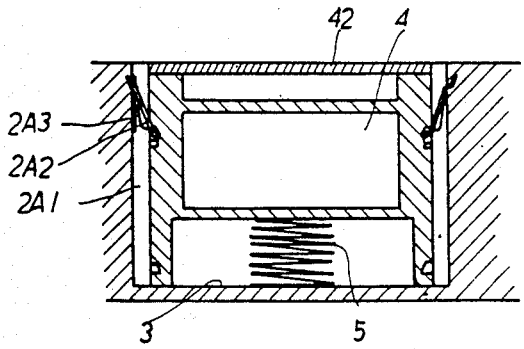
FIG. 3-A
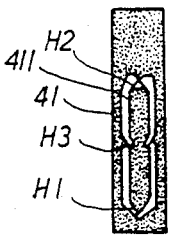
FIG. 4

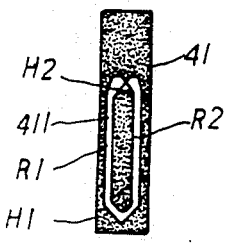
FIG.2-A
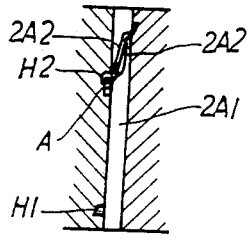
FIG.2-B
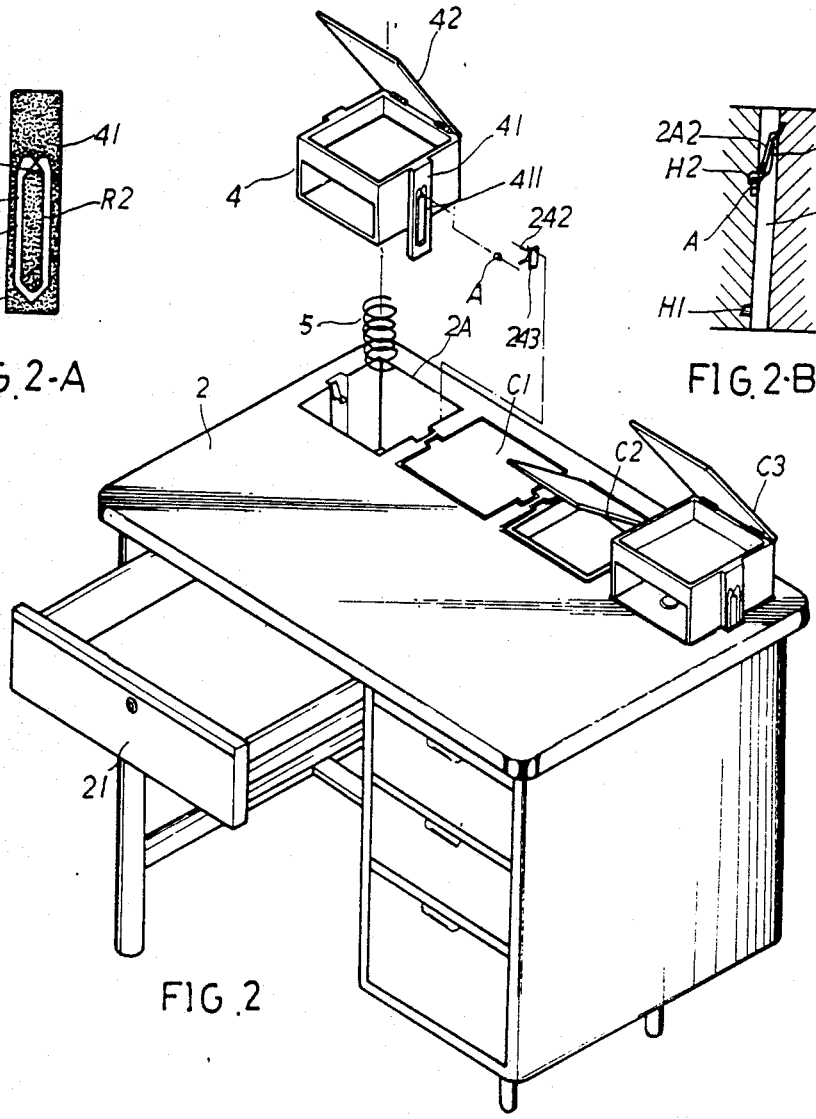
FIG.2
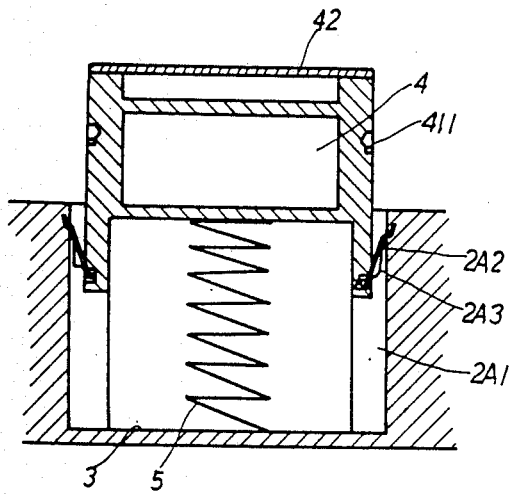
FIG.3-B
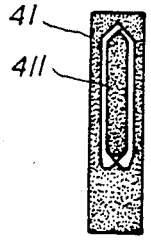
FIG.5

AUXILIARY DRAWER STRUCTURE ON TOP SURFACE ON A DESK

SUMMARY OF THE INVENTION

The present invention relates to a desk surface auxiliary drawer structure which effectively utilizes the spaces of a desk. If is featured that comparatively larger openings are funished on the top face by the rear side of the desk and at the surplus space location. These openings are utilized to receive the box-shaped drawers. The top surfaces fo each lid on each of these drawers are aligned flatly and evenly with the desk face after drawers are inserted into those openings. Extension/compression spring is furnished on the bottom side of each drawer to serve self-rising purpose of each drawer, also guiding blocks and guided-swinging positioning device are furnished to both left and right side respectively of each drawer for locking up when the drawer is risen up to a certain position, or pressed down to its hide-out position. These rising-up and hiding-out functions are repetitive when the drawer is pressed downwardly once after another.

In a traditional desk, such as reading desk, office desk etc., the lengths of the drawers furnished either right under the top face of the desk or by both left and right sides, or by either left or right side are generally shorter than the width of the desk top face due to consideration of articles placed in the furthest location of the drawer can not be easily reached when the drawer is almost pulled out, therefore, a surplus space is left unused as a waste (space under area A shown in FIG. 1).

Based on this finding, the inventor devises an auxiliary drawer structure located in the above siad unused surplus space of a desk for general article storage, also guiding blocks and guided-swinging positioning devices are furnished at both sides of the drawer for repetitive longitudinal rising-up and hiding-out by pressing the drawer downwardly once after another, and these functions constitute the specific features of present invention.

The main purpose of present invention is to provide an auxiliary drawer structure, in particular, this structure can utilize effectively all surplus space of a desk as additional storage spaces for the same desk.

The other purpose of present invention is to provide an auxiliary drawer structure, in which, the auxiliary drawer can be risen up or hided out when the drawer face is pressed downwardly once after another, also, the drawer is located by the rear side of the desk top face at a hand reaching distance from the user, therefore, this drawer not only can provide additional storage space, but it is also convenient to use since the user can rise up or lower down the drawer, or store articles into drawer, or take articles from the drawer only at a hand reaching distance without leaving his/her seat.

Another purpose of present invention is to provide an auxiliary drawer structure, of which, when the auxiliary drawer is pressed down to its hiding-out position, the top surface of the lid for the drawer stays flatly and evenly with the desk top face, therefore an integrality appearance of the desk top face is maintained as well as it provides additional storage space for the desk.

The details of the drawer structure are explained as follows with the help of the accompanying drawings, in which:

DESCRIPTION OF THE DRAWINGS

FIG. 1 shows the implement location view of present invention.

FIG. 2 shows the perspective view of present invention having some of its parts exposed.

FIG. 2-A shows the front side view of the guiding block of present invention.

FIG. 2-B shows the side view of the assembled guided swinging and positioning rod and the left spring.

FIG. 3-A shows the function explanation FIG. 1 of present invention.

FIG. 3-B shows the function explanation FIG. 2 of present function.

FIG. 4 shows another embodiment example of the guiding block FIG. 1 of present invention.

FIG. 5 shows another embodiment example of the guiding block FIG. 2 of present invention.

DETAILED DESCRIPTION

Refer to FIGS. 2 and 2A, present invention provides one or more rectangular openings 2A (in a line, number of openings depend on requirement) on the desk top surface 2 by the rear side portion above the surplus space of which the rear ends of each of the front side drawers can not reach, the underneath spaces of these openings are thus utilized to receiving longitudinally the box-shaped auxiliary drawer bodies 4, underneath these openings 2A at a proper depth, they are furnished respectively with a fixed latitudinal base board 3. In between the base board and the bottom side of each drawer body 4, it is furnished with an extension/compression spring 5 for pushing up the drawer body 4. On both left and right side of the drawer body 4, they are furnished with guiding blocks 41 one each on each side. On each guiding slot 2A1 in each opening 2A it is provided with a guided-swinging and positioning devise which comprises of a runner A, a guided swinging and positioning rod 2A2, and a left spring 2A3. These devises is utilized to lock up the drawer bodies 4 either when the drawer bodies 4 are risen up to a certain position, or the drawer bodies 4 are lowered to their liding-out position, when the drawer bodies 4 are locked up to their hiding-out position, the lid top face 42 of each drawer body 4 is staying flatly and evenly with top face 2 of the desk (as C1 shown in FIG. 2). The drawer body can be a two floorboard design, the top floor just under the lid 42 is a storage box 43, articles can be stored in or taken out when the lid 42 is opened up (as C2 shown in FIG. 2), the bottom floor, having a front side opening, is a storage space 44, it is available for storing-in or taking-out articles only when drawer body 4 is risen up to a certain position, by the extension/compression spring 5, to have the front opening exposed to the user (as C3 shown in FIG. 2). It can be seen from above description, that providing additional storage space, convenient for using, and maintaining the integrity appearance of a desk constitute the main specific features of present invention.

At the longitudinal dent on the external side of the guiding blocks 41, as they are attached to both the left and right side of drawer body 4, it is furnished with a cyclic guiding rail 411, this guiding rail 411 is formed into an elongated heart shape, and on both top end and bottom end of this heat-shaped guiding rail 411, they are furnished with a high position dent point H1 and low position dent point H2 respectively, a plastic runner A attached to the bent end of the guided swinging and positioning rod 2A2 is inserted into the guiding rail 411 and the runner A can move around the guiding rail 411 and rest in either dent point H1 or H2 for locking up the drawer body 4 to the rising-up position (as C3 shown in FIG. 2) or the hiding-out position (as C1,C2 shown in FIG. 2). The rising-up function of the drawer body 4 is furnished by an extension/compression spring 4 between the bottom side of the drawer body 4 and the base board 3. On the both left and right side of opening 2A on desk face 2, they are furnished with guiding troughs 2A1 one each on each side, and the guided-swinging and positioning devices are provided on the inner surfaces of the guiding troughs 2A-1 one each for each guiding trough 2A-1. Each guided-swinging and positioning device comprises of a runner A which is attached to the lower bent end of the lazy S-shaped guided-swinging and positioning rod 2A2 thereinafter, a lazy S-shaped guided-swinging and positioning rod 2A2, and a leaf spring 2A3 (or functionally equivalent component) which provides elasticity to force the lower bent end of the positioning rod 2A2 for alway expanding outwardly. The runner A on the lower bent end of the gided-swinging and positioning rod is inserted into the cyclic guiding rail 411 on the dent of the external surface of guiding block 41, since leaf spring 2A3 exerts elastic force always against the lower bent end of the guided-swinging and positioning rod 2A2, thus the runner A can be seated firmly in the cyclic guiding rail 411 without breaking-off (as shown in FIGS. 3-A and 3-B).

The runner A on the lower bent end of the guided-swinging and positioning rod 2A2 moves cyclically around the guiding rail 411 from high positioning dent point H1 to low positioning dent point H2 or vice versa when top face of the drawer body 4 is pressed downwardly once after another, while both dent points H, and H2 have dual purone of the function is that they are utilized as locking up points for locking up drawer body 4 to the rising-up position or locking up drawer body 4 to the hiding-out position, another function is that they are utilized as position switching points for switching the drawer body 4 from rising-up position to the hiding-out position. In order to obtain above said purpose, guiding rail 411 is furnished with two separate tracks R1 and R2 having opposite slow-rising slope respectively, while dent points H1, H2 are used as demarcation points for this two tracks R1 and R2. For example, the slope of track R1 is the lowest at high position dent point H, and it rises gradually from this point until it reaches the highest slope point then falling into low position dent point H2; For another example, the slope of track R2 is the lowest at low position dent H2, and it rises grodually from this point until it reaches the highest slope point then falling into high position dent point H1. Therefore, when each time the top face of the drawer body 4 is pressed downwardly, the runner A on lower bent end of swinging and positioning rod 2A2 will be unlocked from the present positioning dent (H1 or H2), and switched to another track (R1 or R2), and moved and locked to another positioning dent (H1 or H2) by the expansion force of leaf spring 2A3 and the extension froce of extension/compression spring 5, as shown in FIGS. 3A, 3B. At hiding-out position, when the top face of the drawer body 4 is pressed downwardly, the runner A on lower bent end of guided swinging and positioning rod 2A2 will be switched to, via the bridge on low position dent H2, and risen up via track R2, and positioned and locked to the bridge of high position dent point H1 (as shown in FIG. 3B); while at risen-up position, when the top face of the drawer body 4 is pressed downwardly, the runner A on lower bent end of guided swinging and positioning rod 2A2 will be switched to, via the bridge on high position dent point H1, and lowered down via track R1, and positioned and locked to the bridge of low position dent point H2 (as shown in FIG. 3A). From above description it can be seen that the auxiliary drawer structure in addition to provide more storage spaces for the user, it is also convenient and easy to use, these advantages constitute the main specific features of present invention.

Further more, the slow-rising slop provided in the tracks R1 and R2 of cyclic guiding rails 411 on both left and right side of drawer body 4 can be a two step structure (as shown in FIG. 4), in this manner when the runner A on lower bent end of guided swinging and positioning rod 2A2 moves up from low position dent point H1 to the intermediate position dent point H3, the drawer body 4 will be risen up half way; pressing the top face of drawer body again, the runner A on lower bent end of guided swinging and positioning rod 2A2 will be disengaged from the intermediate position dent point H3 and enters into the high position dent point H2, at this time the drawer body will be risen to the highest position; it then returning the drawer body 4 into its hiding-out position is required, the only thing to do is to press the top face of the drawer body 4 downwardly until the runner A on bent end of the gided swinging and positioning rod 2A2 is locked or engaged to the low position dent point H2, the drawer body thence will locked firmly to its hiding-out position. Because the drawer body is operated in two steps, which constitute another specific feature of present invention.

Still further, the location of the guiding blocks 41 on both sides of the drawer body 4 and the guiding troughs 2A1 on both sides of opening 2A can be interchanged, i.e., guiding troughs 2A1 are furnished on left and right sides of drawer body 4, and guiding blocks are furnished on the left and right sides of the opening 2A. Corresponding location change is also made to the guiding rails 411 and guided swinging and positioning devices as shown in FIG. 5. In this manner, same purpose can be served as before.

As a summary to above description, since the present invention can surely and effectively increase the storage space of a desk, also it is convenient for a user to utilize effectively this newly added storage spaces which meets all requirements for the application for patent rights, based on this understanding the inventor submits this patent right application for your approval.

I claim:

1. A desk top face auxiliary drawer structure utilizing the surplus space in the rear portion of a desk, which comprises of several openings furnished on the top surface by the rear side portion of a desk; corresponding number of base boards furnished underneath the said openings at a proper depth; corresponding number of drawer bodies to be inserted into the said openings; corresponding number of extension/compression springs to be installed between each said base board and the bottom side of each said drawer body; guiding blocks furnished on both left and right sides of each said drawer body; guiding troughs furnished on both left and right sides of each openings as they are utilized to receiving said guiding blocks when each said drawer is inserted into each said openings; guided swinging and positioning devices, each device comprises of a runner attached to the lower bent end of guided swinging and positioning rod, a guided swinging and positioning rod, a leaf spring, and these devices are installed on the inner wall of the said troughs, one for each trough; cyclic guiding rails having cyclic trucks, they are attached to the external surfaces of the said guiding blocks, one for each guiding block, and the said guiding rails are utilized to receive the said runners on the lower bent end of the said guided swinging and positioning rod, through the mechanism of the said extension/compression spring, the said guided swinging and positioning devices, and the said cyclic guiding rails and its tracks the drawer bodies can be risen up and locked to its rising-up position or be lowered down and locked to its hiding-out position by pressing the top surface of each drawer body downwardly once after another.

2. A desk top face auxiliary drawer structure as set forth above in claim 1, of which the cyclic guiding rail on external surface of each guiding rail is furnished with two respective opposite slow-rising slope trucks R1 and R2, and the intersection points of R1 and R2 is the respective high position dent point H1 and low position dent point H2, these two points are utilized for the engaging-in of guided swinging and position rod to position and lock the drawer body to its rising-up and hiding-out position respectively.

3. A desk top face auxiliary drawer structure as set forth above in claim 1, of which, the upper end of the guided swinging and positioning rod is pivoted to the guided trough to provide the swinging function at its lower end.

4. A desk top face auxiliary drawer structure as set forth above in claim 1, of which, the leaf spring is firmly fixed to the inner wall of the guiding trough between the guiding trough and the guided swinging and positioning rod, this spring is utilized to push the runner on the lower bent end of the guided swinging and positioning rod into the above said tracks of the cyclic guiding rail.

5. A desk top face auxiliary drawer structure as set forth in claim 2, of which, intermediate position dent points H3 are furnished between the high position dent point H1 and low position dent point H2 for providing the drawer body with step by step rising-up to its intermediate position and high position or lowering-down to its hiding-out position.

* * * * *